US008714652B2

(12) United States Patent
Whidden et al.

(10) Patent No.: US 8,714,652 B2
(45) Date of Patent: May 6, 2014

(54) MODULAR FURNITURE UTILIZING SECURELY STACKED FRAMES

(75) Inventors: William L. Whidden, Orlando, FL (US); Lawrence W. Bechtold, Orlando, FL (US)

(73) Assignee: Ice Magic Holdings, Inc., Orlando, FL (US)

( * ) Notice: Subject to any disclaimer, the term of this patent is extended or adjusted under 35 U.S.C. 154(b) by 400 days.

(21) Appl. No.: 13/065,957

(22) Filed: Apr. 4, 2011

(65) Prior Publication Data

US 2012/0248834 A1 Oct. 4, 2012

(51) Int. Cl.
*A47C 7/00* (2006.01)

(52) U.S. Cl.
USPC ..... 297/440.15; 297/440.14; 297/248; 297/239; 211/188; 211/194

(58) Field of Classification Search
USPC ..... 297/440.13, 440.14, 440.15, 239, 233, 297/451.8, 248; 211/188, 194
See application file for complete search history.

(56) References Cited

U.S. PATENT DOCUMENTS

| | | | | | |
|---|---|---|---|---|---|
| 321,825 | A | * | 7/1885 | Koenig, Jr. | 297/108 |
| 816,209 | A | * | 3/1906 | Beall | 297/343 |
| 863,874 | A | * | 8/1907 | Rajner | 297/115 |
| 2,466,204 | A | | 4/1949 | Brown | |
| 2,529,687 | A | * | 11/1950 | Greenbaum | 297/134 |
| 2,566,818 | A | * | 9/1951 | Babit | 297/239 |
| 2,793,685 | A | | 5/1957 | Spitz | |
| RE26,071 | E | * | 8/1966 | Rowland | 297/239 |
| 3,608,959 | A | | 9/1971 | Sarvas | |
| 3,658,382 | A | * | 4/1972 | Anderson | 297/451.8 |
| 3,672,723 | A | * | 6/1972 | Decursu | 297/440.24 |
| 3,685,063 | A | * | 8/1972 | Morgan | 5/400 |
| 3,834,324 | A | * | 9/1974 | Lang | 108/91 |
| 3,973,800 | A | * | 8/1976 | Kogan | 297/440.23 |
| 4,395,071 | A | * | 7/1983 | Laird | 297/440.21 |
| 4,428,487 | A | * | 1/1984 | Hepp | 211/126.12 |
| 4,523,787 | A | * | 6/1985 | Robinson | 297/440.2 |
| 4,755,000 | A | * | 7/1988 | Chiaro et al. | 297/440.15 |
| 4,879,774 | A | * | 11/1989 | Sanders | 5/8 |
| 4,932,720 | A | | 6/1990 | Sherman | |
| 5,000,512 | A | * | 3/1991 | Laird | 297/440.1 |
| 5,112,110 | A | * | 5/1992 | Perkins | 297/440.21 |
| 5,147,120 | A | * | 9/1992 | Ray | 312/111 |
| 5,218,914 | A | * | 6/1993 | Dickinson | 108/64 |
| 6,241,317 | B1 | | 6/2001 | Wu | |
| 6,364,133 | B1 | * | 4/2002 | Sheng | 211/46 |
| 7,066,342 | B2 | * | 6/2006 | Baechle et al. | 211/191 |
| 7,137,517 | B2 | * | 11/2006 | Lowry et al. | 211/188 |
| 7,575,283 | B2 | * | 8/2009 | Crowe | 297/440.1 |

FOREIGN PATENT DOCUMENTS

| | | | | | |
|---|---|---|---|---|---|
| GB | 2040159 | A | * | 8/1980 | A47C 4/00 |

* cited by examiner

*Primary Examiner* — David E Allred
(74) *Attorney, Agent, or Firm* — Julian C. Renfro, Esq.

(57) ABSTRACT

A frame of rectangular configuration, constructed of structural components and usable in connection with modular furniture. Front and back frame components are interconnected by a pair of side components, and a locking bar member extends between the side components and is movable therealong while remaining essentially parallel to the back component. The locking bar member has a straight edge in alignment with and parallel to a straight edge of the back component, such that when the locking bar member is brought into a relatively close relation to the back component, the straight edges of the back component and the locking bar member can hold therebetween a backrest equipped with cleats in a secure, fixed position, without the need for screws, bolts, pins or other joinder elements.

21 Claims, 8 Drawing Sheets

FIG 6
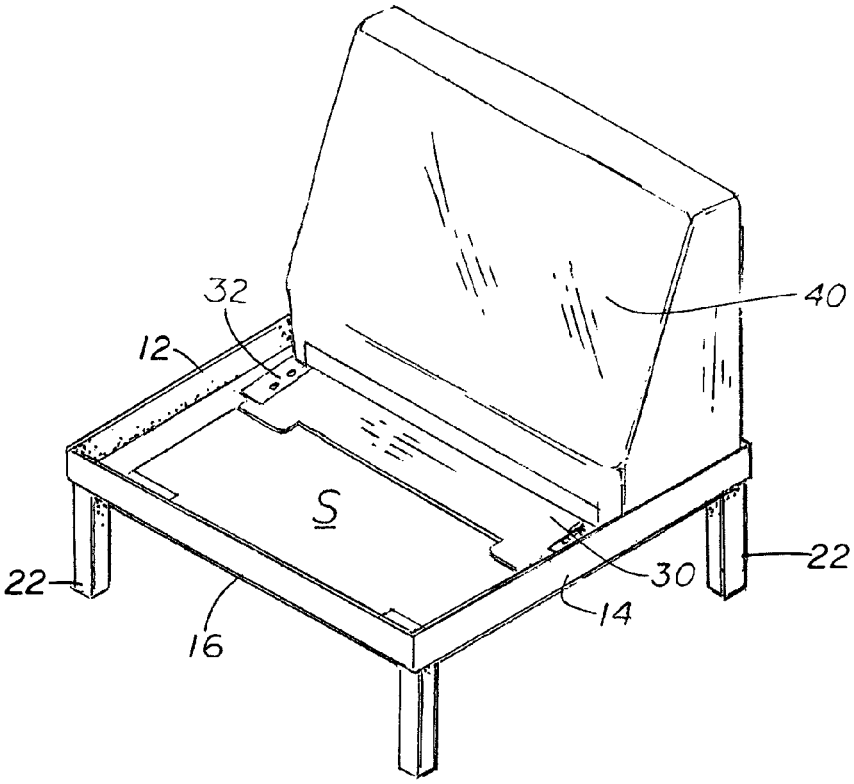
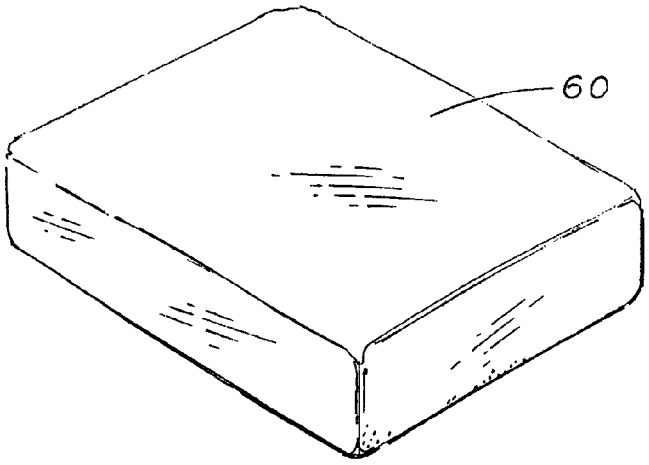
FIG 7

FIG 8
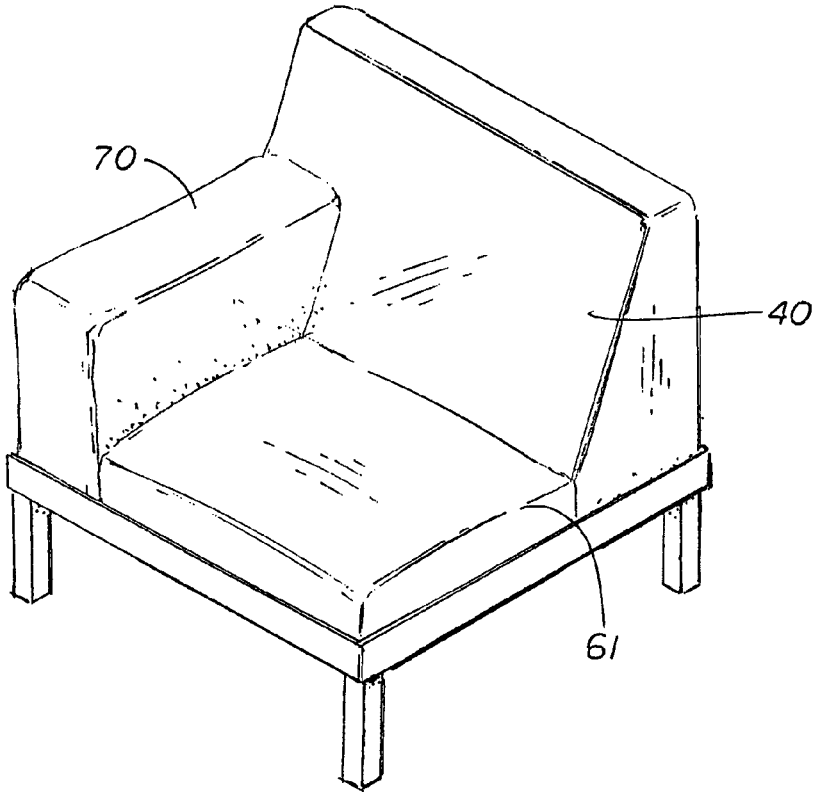
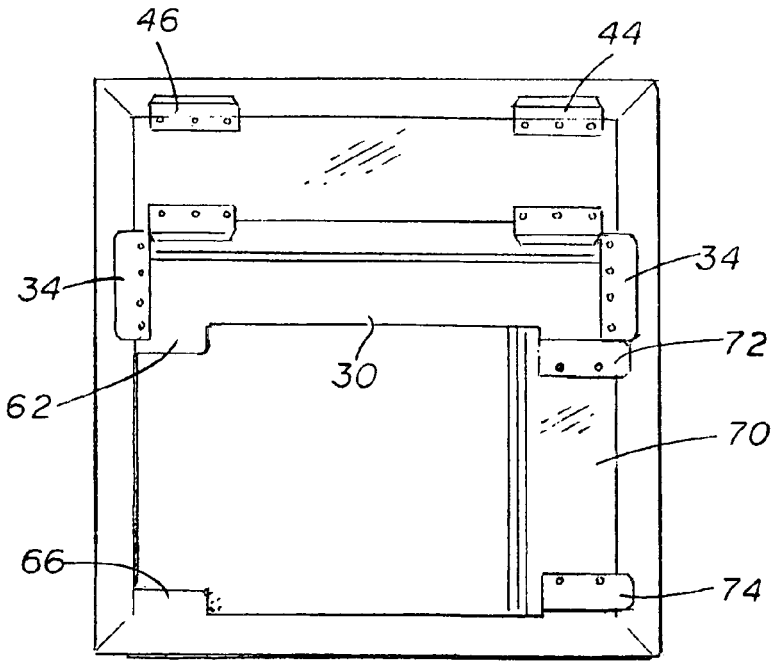
FIG 9

MODULAR FURNITURE UTILIZING SECURELY STACKED FRAMES

FIELD OF THE INVENTION

This invention relates to the field of modular, ready to assemble furniture, and more particularly to readily stackable frames that can be easily transported and then assembled into chairs or couches by one person working alone.

BACKGROUND OF THE INVENTION

It is well known in the art to provide modular furniture that can be stored in a compacted condition, and when moved to a destination or point of use, can be assembled into fully operational components. The modular furniture of the prior art can take the form of chairs or sofas, and may utilize techniques such as those shown in the Brown U.S. Pat. No. 2,466,204.

The Spitz U.S. Pat. No. 2,793,685 shows chairs as well as sofas that can be assembled from components, in this instance utilizing and necessitating many fastening means.

The Sarvas U.S. Pat. No. 3,608,959 shows a sofa whose elongate backrest is provided with means whereby it can be mounted on a seat portion, but his arrangement would require the services of at least two installers in order that the elongate members can be moved from a truck into the auditorium, convention center or other event location.

The Sherman U.S. Pat. No. 4,932,720 involves what he calls a perimetric horizontal frame having projecting lip portions and utilizing a hollow removable back portion. However, Sherman's frame would require the services of at least two people in order for his elongate components to be transported from the delivery truck to the place of use.

The Wu U.S. Pat. No. 6,241,317 utilizes an elongate backrest having means permitting it to be mounted into a seat unit, but again his elongate components would require two people in order for his components to be moved from the delivery truck to the place of use.

It was in an effort to overcome the obvious difficulties associated with these prior art devices, and to enable a single person working alone to set up modular furniture for an event that the present invention was evolved.

BRIEF SUMMARY OF THE INVENTION

In accordance with this invention, we have provided a novel frame for use in connection with modular furniture, with this frame being easily stored, and when stacked and then transported with a number of like frames to a location of use, is able to be effectively used in the creation of chairs, loveseats or couches. Frames created in accordance with our design are able to receive backrest components securely held in place, and also receive seat components. Most significantly, these components are held in place without the use of removable screws, bolts or pins, nor do they require the use of any tools. Most advantageously, chairs, sofas or the like can be set up by a single laborer working alone.

Our novel frame is made up of structural components arrayed in a rectangular configuration, with one of these components being designated as the front member, and the member at the opposite end of the frame regarded as the back member. These front and back members are interconnected by side components, with the front and back components and the side components each preferably utilizing an inwardly directed, horizontally projecting lip element.

Significantly, a locking bar member extends between the side components, being slidably mounted on the horizontally projecting lip elements of the side members. This locking bar member is easily movable along the side components while remaining essentially parallel to the back member. The locking bar member serves to define a first area between it and the front member, and a second area between it and the back member.

The locking bar member has an edge in alignment with the horizontal lip element of the back member, such that when the locking bar member is brought into a relatively close relation to the back member, the locking bar member can hold a backrest equipped with cleats in a secure, fixed position. The movement of the locking bar member toward the back member causes the first area to enlarge, and the second area to diminish. As a result of this, blocking means can be placed in the first area in such a position as to prevent the locking bar member from moving away from a position in which it securely maintains the backrest in its operative position.

One of the blocking means can take the form of a seat cushion that is tightly received in the frame between the side components, the front member and the locking bar member, which serves to prevent the backrest from moving away from its operative position. Another of the blocking means can take the form of an arm rest contacting one of the side components and the locking bar member, and being in contact with a somewhat smaller seat cushion.

In accordance with this invention we provide means for joining two or three of our novel frames together for the creation of a loveseat or sofa, as the case may be. One of the joinder means may involve one side member of each frame carrying a spaced pair of pivotally mounted joinder members. Provided on the other side of each frame are a pair of studs or lugs, which are spaced to correspond with the placement of the pivotally mounted members, or in other words, each pivotally mounted joinder member on one frame is in a complimentary relationship with a stud or lug on the adjacent frame. As a result of this arrangement, when two like frames have been placed closely together in a properly aligned relationship, each pivotally mounted joinder member can be moved into a locking relation with the corresponding stud or lug carried on the adjacent frame. When so joined, the frames can be moved as a unit from one location to another. The joinder of two of our novel frames enables a loveseat to be created, whereas the joinder of three frames enables a sofa or couch to be created. As is obvious, dismantling of the joined frames can be easily accomplished when the event is over.

So that one person, working alone can get a number of our frames conveniently into the conference room or other event location, we provide a frame configuration permitting five, six or more frames to be securely stacked onto a small wheeled device, and then rolled into the location of use.

The secure stacking of a plurality of our novel frames is made possible because in accordance with this invention, we indent or recess each of the supporting legs away from the adjacent outer edges (corner) of the frame, such that the supporting legs of an upper frame do not contact the upstanding or vertically arrayed leg or flange of the structural members of a lower frame. Because when stacked, the lower portion of the support legs of each frame are bounded or enclosed by the upstanding legs or flanges of the structural members of the frame residing therebelow, a plurality of our frames can be stacked into a very secure relationship on a small wheeled device. In other words, because each support leg of an upper frame is bounded or enclosed by the intersecting upstanding legs or flanges of a lower frame, any shifting of the frames when multiple frames are placed in a stack is highly unlikely. Flanges on the wheeled device are in contact with the supporting legs of the lowermost frame of the stack, preventing any undesirable shifting.

It is therefore an object of our invention to provide a basic frame making it convenient for one person to set up multiple furniture items for use by patrons, this being possible because the combined use of two or more of our novel frames enables a love seat, sofa or couch to be set up without requiring the use of a second person to help transport elongate components.

Another object of our invention is to provide a basic structural frame usable alone or in combination with one or more like frames, with this basic frame making possible the set up of various items of furniture for public use without necessitating the use of a second person in order that elongate furniture components can be moved from a delivery truck to the place of use.

Still another object of our invention is to provide novel frames that can be readily stacked in a particularly stable manner on a wheeled cart, dolly or the like and then transported without shifting into an auditorium, convention hall or the like by a single person working alone, which frames can then be readily assembled together without the use of screws, bolts or pins, and without the use of tools of any kind.

These and other objects, features and advantages will become more apparent from a study of the appended drawings.

BRIEF DESCRIPTION OF THE DRAWINGS

FIG. 1 is an isometric view of our basic frame typically used in multiples, to be employed in the creation of chairs, sofas or the like;

FIG. 6 is a view generally along the lines of FIG. 2, but here showing the slidably mounted locking bar moved into a position in which it holds or clamps the backrest in its operative condition;

FIG. 7 is an isometric view to a somewhat larger scale of a seat cushion of the type to be received on the frame depicted in FIG. 6, with a properly sized seat cushion serving to prevent the backrest from moving out of a secure position;

FIG. 8 is another view showing our backrest in its operative position, with this view revealing an armrest in its operative position, with a somewhat smaller seat cushion being utilized to assure that the armrest and the backrest remain in operative positions;

FIG. 9 is a view of the underside of our novel frame, in this instance being relatable to FIG. 8 and revealing the utilization of cleats on the underside of the armrest in order for it to be secured in its operative position;

DETAILED DESCRIPTION

This invention relates to an arrangement for storing furniture components in compacted form, with such components being able, when the occasion arrives, to be quickly assembled into highly effective, usable configurations at an event location, such as at a ballroom, auditorium, convention center or the like.

Figure 1:
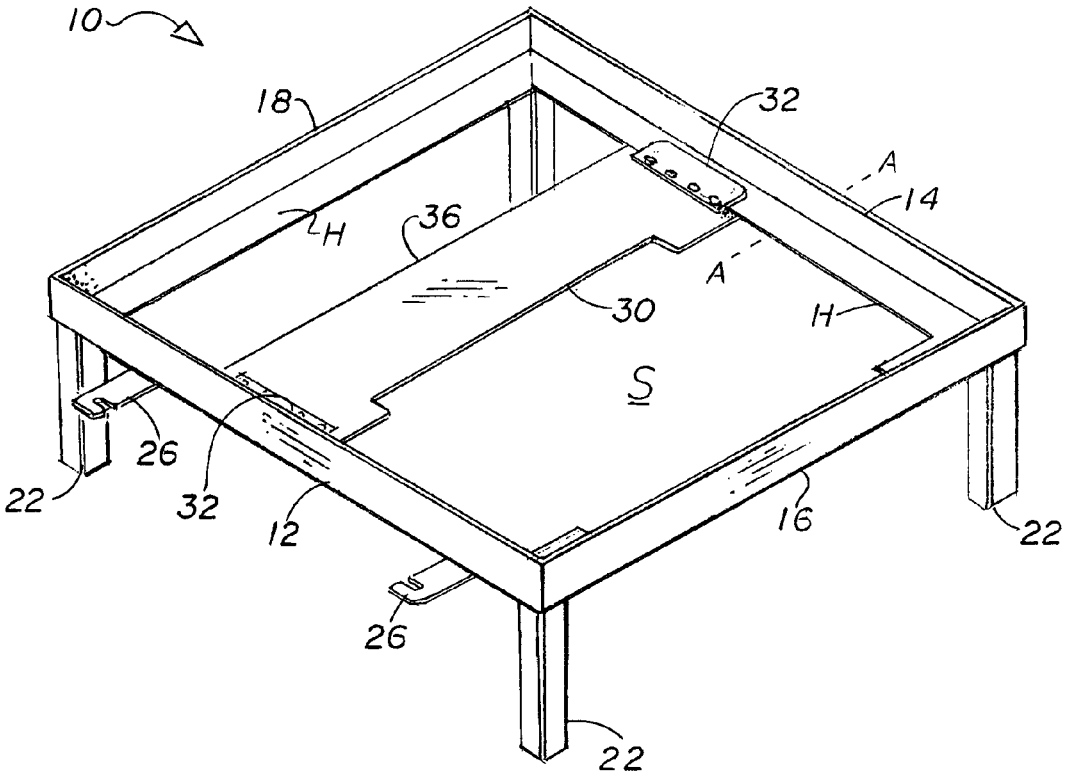

With reference to FIG. 1 it will be seen that we have there shown a basic, rectangularly-shaped metal frame 10, to be created in quantity. This novel frame can be used singly, or two or more of such frames can be readily assembled into a configuration suitable for the seating of several people.

With continuing reference to FIG. 1, this basic frame 10 is constructed of a front member 16, a back member 18, and side members 12 and 14 serving to join the front and back members together to form a sturdy rectangular relationship. For some installations we have found that the use of steel for the frame members is preferable, but for other installations the use of aluminum or another suitable material in the construction of the frames may be preferable.

The four corners where these elongate structural members come together are tightly secured, preferably by being welded, so as to bring about the desired sturdy rectangularly shaped frame. For many installations we have found that the angle members constituting the side members 12 and 14 are each 32 inches long, whereas the front and back members are each 30 inches wide. Frames of this size can be easily carried through doorways, but quite obviously, these measurements are not to be regarded as limiting.

Figure 1A:
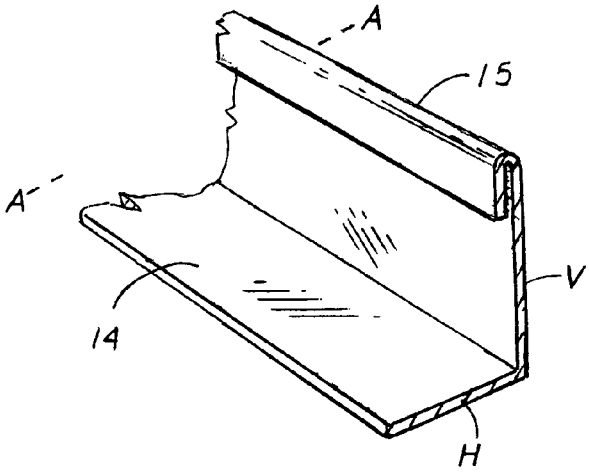
FIG. 1A reveals the preferred cross sectional configuration of a side member of our basic frame.

As revealed in FIG. 1A, one leg of member 14, leg H, is directed inwardly, in a horizontal plane, whereas the other leg, leg V, is directed upwardly. Usually there is approximately a 90 degree angle between the legs H and V, but we are not to be limited to this, for the angle between the legs could be somewhat greater than 90 degrees, or somewhat less than 90 degrees. It is to be understood that in accordance with this particular embodiment, each of the four frame members has an inwardly directed leg or lip H, as well as an upwardly directed leg.

Continuing with FIG. 1A, we may utilize a bent over portion 15 along the upper edge of the structural member. This type of upper edge for all of the frame members makes possible a relatively effortless insertion of a seat cushion down between the upstanding vertically disposed legs of the frame members. We find that this arrangement is preferable to having vertical frame members presenting "raw" edges, that might tend to impede the insertion of a seat cushion.

The frame 10 is supported by four feet or support legs 22, which support legs are spaced somewhat inwardly from the corners of the frame to permit a very secure stacking of the frames, as will be described hereinafter. It being a significant facet of our invention that the setup of our furniture in an event location such as an auditorium or the like can be accomplished by a single person working alone, it is important to note that the worker can bring some five or six of our novel frames into the event location at one time on a small wheeled device without requiring the services of a second person, and without the danger of some of the frames slipping off the wheeled device. This point will be dealt with in more detail in connection with FIG. 13.

Also revealed in FIG. 1 are a pair of joinder members 26 that are pivotally mounted on frame member 12, which joinder members will be described in detail hereinafter. These joinder members are to be used when two or more of our basic frames are to be secured together to provide seating for two or more people.

Figure 2:
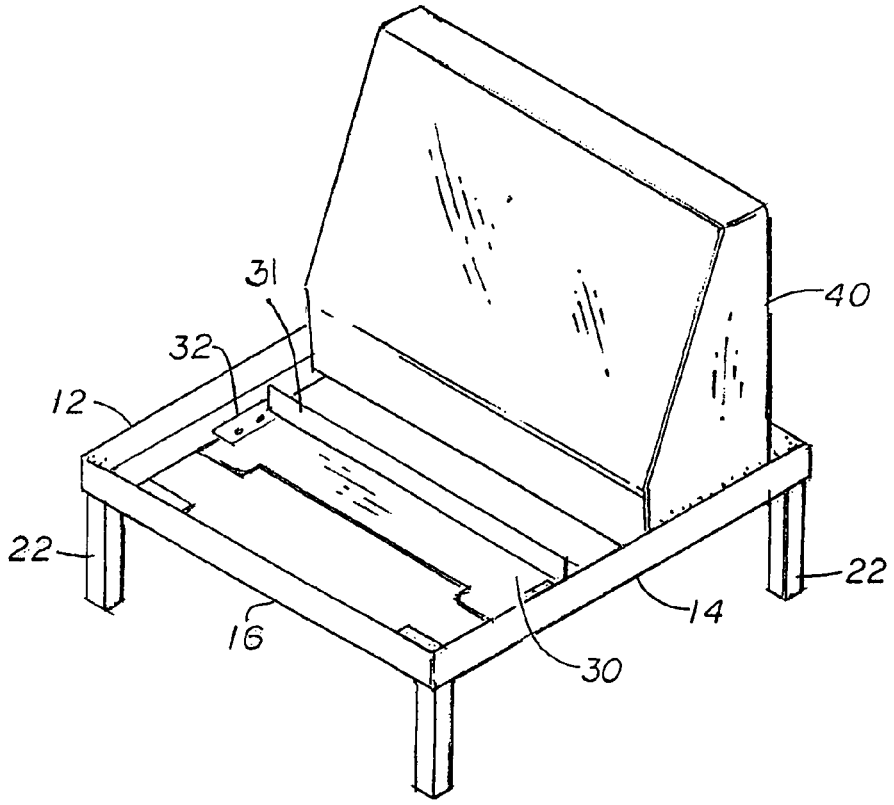
FIG. 2 is a view of our frame showing a backrest placed at one end of the frame but not yet firmly secured in a functional position.

A particularly important part of our novel frame involves the provision of a slidable locking bar member 30, each end of which is supported from the respective inwardly-directed leg or lips H of the side members 12 and 14. We may use a strengthening member 31 affixed to the central or "parent" portion of the elongate locking bar member, as shown in FIG. 2. We have found that the central or "parent" portion of the locking bar member need not actually contact the lips H of the side members, but rather we prefer to effectively extend the length of the locking bar by the use of short upper plates 32, which are positioned so as not to interfere with the sliding action of the locking bar 30 along the lips H. Not visible in this figure are the short lower plates 34, which reside on the underside of the frame; note FIG. 4.

By the use of short bolts or other securing means the upper plates 32 and the lower plates 34 are secured together at each end of the locking bar 30 to effectively extend its length, such that the "parent" or central portion of the locking bar resides in the plane of the lips H, with the upper and lower plates serving to slidably clamp the locking bar member 30 to the lips or legs H of the side members of the frame 10. We may use a spacer member in contact with the upper or lower plates so as to assure a desired amount of clearance, so that the locking bar can be easily moved along the lips H of the side components. As a result of this construction, the locking bar 30 is readily movable, without binding, along the lips H toward or away from the back member 18 of the frame 10 without being dislodged from the side members 12 and 14. It is to be noted that the locking bar has a straight edge 36 on the edge facing the back member 18, with this straight edge remaining parallel to the inwardly directed lip H of the back member 18 during movements of the locking bar member.

It is to be observed in FIG. 1 and certain other figures that a space or area S is defined between the front frame member 16, the side members 12 and 14, and the locking bar 30. We may refer to this space as the first area, which area enlarges somewhat as the locking bar is moved toward the back member 18. A second area is defined between the locking bar member, the side members and the back member 18.

The initial furniture component used with our basic metal frame 10 is an upstanding backrest 40, visible in FIG. 2. It is to be understood that the backrest is to be held in secure contact with the rear member 18 of the frame by the use of the locking bar 30, but in FIG. 2, the locking bar has not been moved into locking contact with the backrest.

Figure 3:
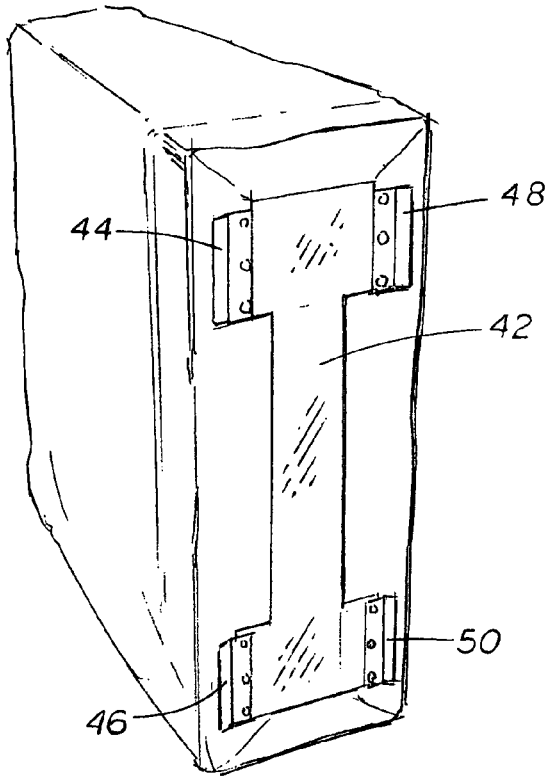
FIG. 3 is a view of the underside of the backrest, showing latching members, such as cleats or clips, to be used in firmly locking the backrest in its operative position on the frame.

In FIG. 3 we have shown the underside of the backrest 40, with this view revealing a flat bottom structural member 42 to which special clips or cleats are attached. It will be noted from this figure that clips 44 and 46 are rearwardly facing whereas clips 48 and 50 are forwardly facing. All four of these clips or cleats are spaced slightly away from the bottom surface 42 of the backrest, so as to permit each clip to receive thereunder a relatively thin structural member.

Figure 4:
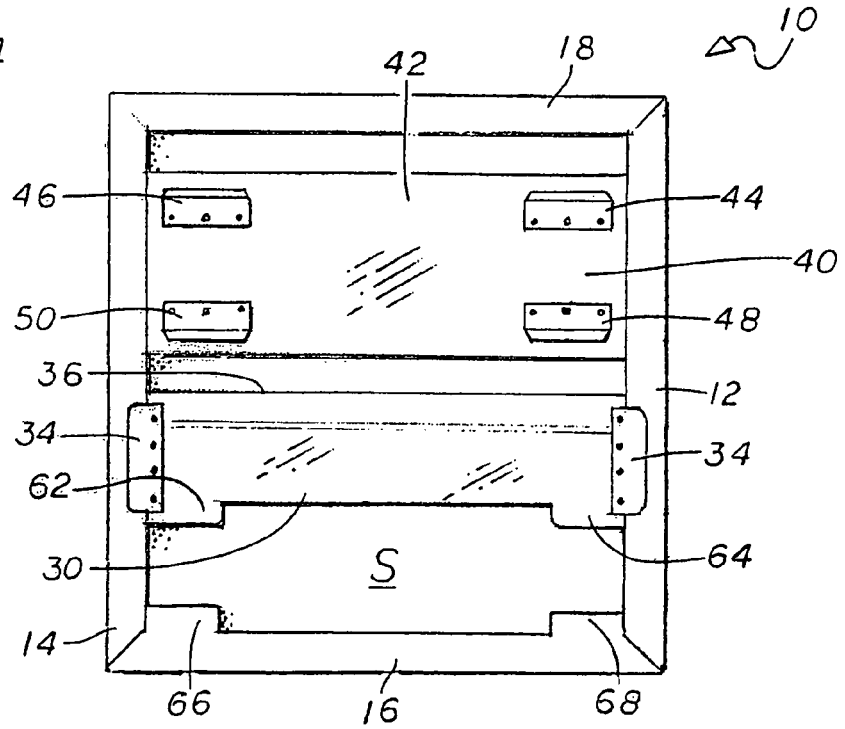
FIG. 4 is a view of the underside of our novel frame showing the underside of the backrest and also revealing our novel, slidably mounted locking bar, which in this instance is residing a spaced distance from the backrest.

With reference to FIG. 4, this is a view of the underside of our novel frame 10, revealing some of the bottom detail of the backrest 40. In this instance the outer edges of the backrest are residing on the horizontally-disposed legs (lips) of the side members 12 and 14. To be noted in this figure are the lower plates 34 secured to the underside of the left and right ends of the locking bar. It will be recalled that these plates, in concert with the previously mentioned upper plates 32, are responsible for extending the effective length of the locking bar, and keeping it in a readily slidable yet captive relationship with the side components 12 and 14. Also to be noted in this figure is the straight edge 36 of the slidable locking bar 30, which may be regarded as the active edge of the locking bar. In FIG. 4 the locking bar has not been brought into contact with the backrest.

Also to be noted in FIG. 4 are enlargements 62 and 64 on the ends of the locking bar 30, which bear some resemblance to the enlargements 66 and 68 near the ends of the front structural member 16. These enlargements will hereafter be discussed in connection with the use of an armrest on our novel frame.

Figure 5:
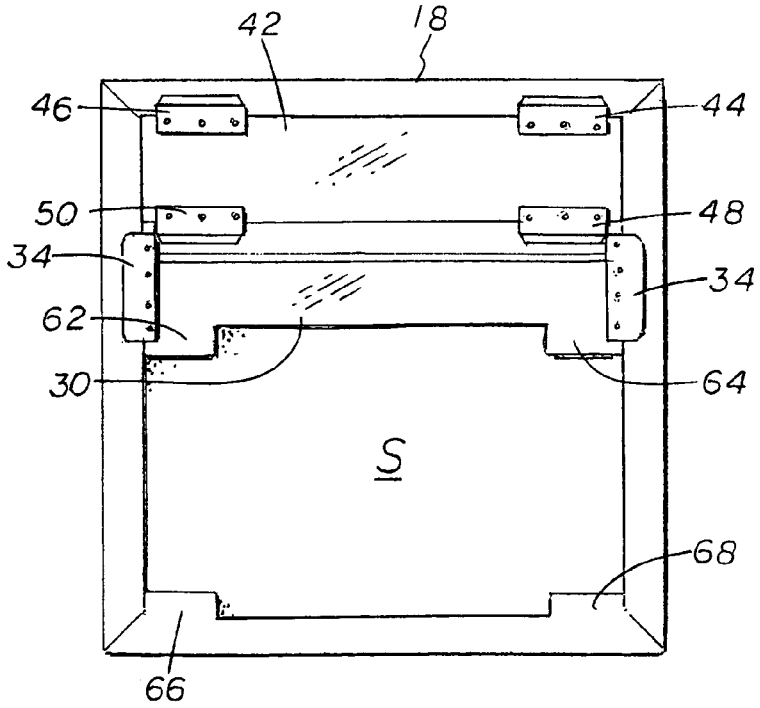
FIG. 5 is another view of the underside of our novel frame, but in this instance, showing the slidably mounted locking bar having been moved into a position in which it serves to secure the backrest in a stable, operative condition.

Referring now to FIG. 5, it will be seen that this figure bears a distinct similarity to FIG. 4, but in FIG. 5, the backrest 40 has been moved into such a relationship to the rear frame member 18 that the clips or cleats 44 and 46 are closely received by the horizontally disposed leg or lip of the rear frame member 18. Also revealed in FIG. 5 is the fact that the locking bar 30 has been moved into contact with the lower front portion of the backrest 40, such that the straight edge 36 of the locking bar slides under the clips 48 and 50. At this point, the backrest 40 is firmly locked in the upstanding position, as long as the locking bar 30 is not moved. Also, the strengthening member 31 is in contact with the lower portion of the backrest, assuring sufficient room for the seat cushion to be received.

Referring now to FIG. 6, it will be seen that this figure bears a resemblance to FIG. 2 except that the upstanding backrest 40 is revealed in its operative position in FIG. 6, with the active edge of the locking bar 30 bearing against the lower part of the backrest 40. It is to be observed that the previously mentioned area or space S exists between the front frame member 16, the side members 12 and 14, and the forward edge of the backrest 40. This space or area is intended to receive a blocking means, such as a seat cushion of a precise configuration, constructed generally along the lines of the seat cushion 60 shown in FIG. 7. This cushion has a defined base portion designed to remain within the vertically disposed legs or upstanding edges V of the frame members. Preferably the cushion 60 rests upon the inwardly directed edges H of the side members 12 and 14, the inwardly directed leg H of the front member 16, and an edge of the locking bar. Because the front to back dimension of the seat cushion 60 is sized to fit closely between the front frame member and a lower front portion of the backrest 40, this serves the purpose of blocking and preventing the slidable locking bar 30 from moving out of contact with the clips or cleats on the underside of the backrest. In other words, the placement of the seat cushion 60 on the forward portion of the frame serves to lock the backrest into a stable position, from which it will not be dislodged during the moving of the furniture from one position to another inside the auditorium or event area.

The bottom of the seat cushion may be made of plywood, plastic or some other suitable rigid material, to assure the backrest being kept in place, and to prevent sagging of the seat cushion.

With reference to FIG. 8 it is to be seen that we may utilize an arm rest 70, held in place by clips or cleats 72 and 74 on its underside, as shown in FIG. 9. As is obvious, when using an armrest, we use a seat cushion 61, which is a somewhat smaller seat cushion than cushion 60 previously described. The clip 72 is in active contact with the previously mentioned enlargement 64 of the locking bar, and the clip 74 is in active contact with enlargement 68 of the front structural member 16, although these enlargements are not visible in FIG. 9.

One of the most significant uses of our novel frame 10 is in the creation of a love seat, involving a pair of our basic frames, or in the creation of a couch or sofa, involving three or perhaps more of our novel frames joined together. It will be recalled that we mentioned in connection with FIG. 1 that we have provided joinder members 26 pivotally mounted in a spaced apart relation on the side member 12.

Figure 10A:
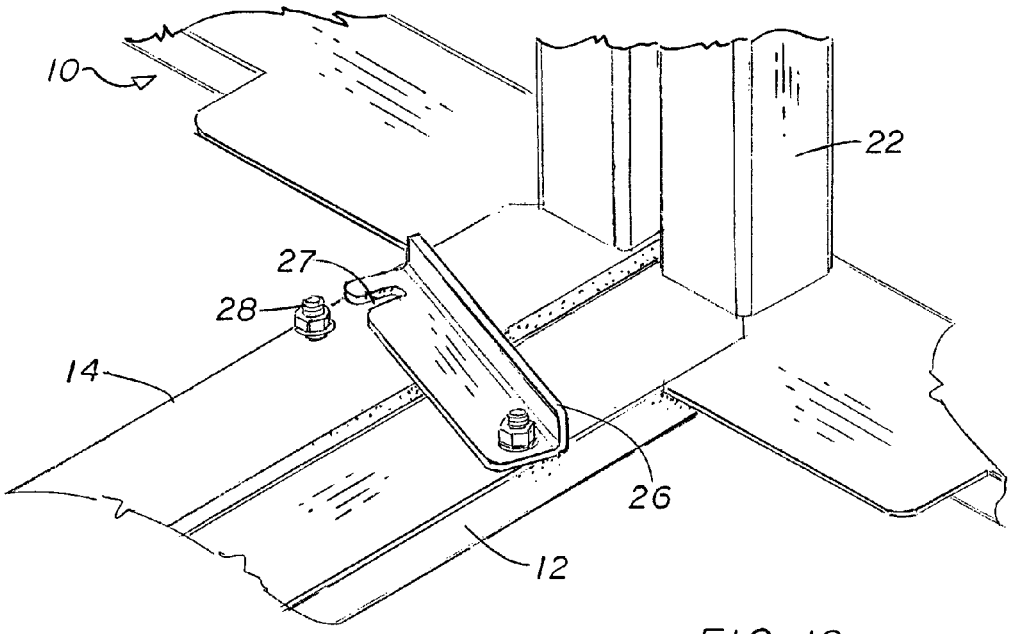
FIG. 10*a* is a fragmentary view of a portion of the underside of two closely aligned, like frames, with the joinder member mounted on the one frame not yet having been moved to the locking position.
Figure 10B:
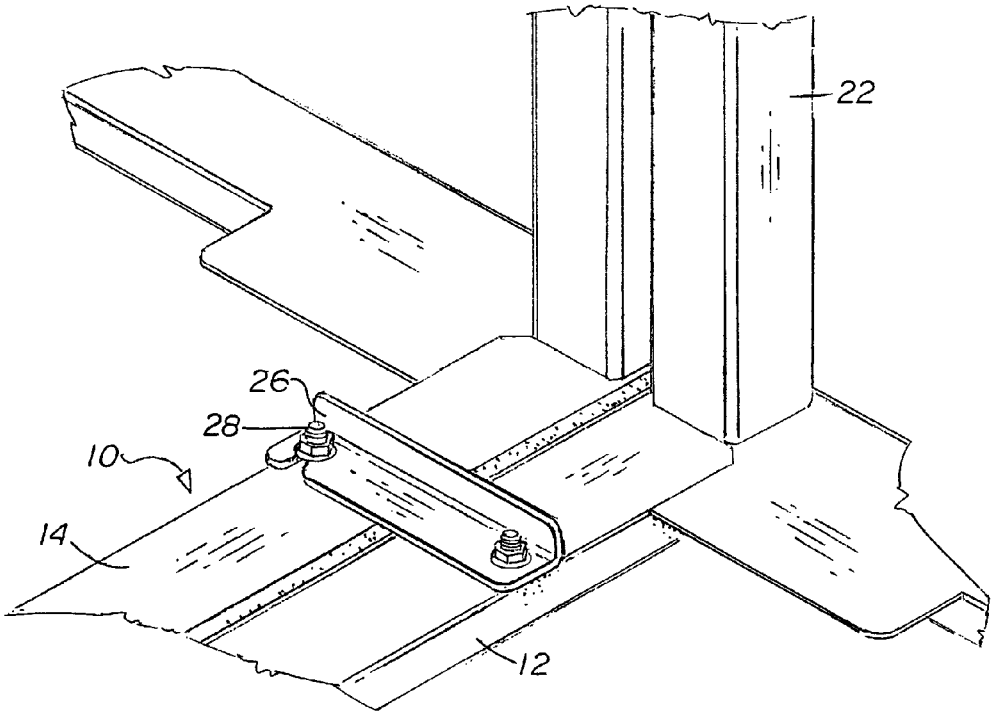
FIG. 10*b* is a fragmentary view closely related to FIG. 10*a*, with the joinder member here having been moved to the position engaging the stud or lug of the other frame, thus securing the two substantially identical frames together.

With reference to FIGS. 10*a* and 10*b*, in FIG. 10*a* we have shown a close up detail of a preferred form of joinder member 26, which in this instance is out of contact with the stud or lug 28 affixed to side member 14 of an adjacent frame. We may also refer to the pivotally mounted members 26 as locking components, and we regard the joinder members as being in an aligned or complementary relationship with the studs or lugs. After the two adjacent ones of our basic frame are in precise alignment, each joinder member 26 of the side component 12 of one frame is in alignment with a stud or lug 28 located on side member 14 of the adjacent frame. Because of the like positioning of the joinder members and the studs or lugs, we regard the members 26 and 28 as being locking components of a complementary type. As will be apparent, each joinder member 26 can be readily rotated so that the slot 27 in this member moves into locking contact with the adjacent stud 28; note FIG. 10*b*.

We have found that two joinder members 26 mounted on the side member of one frame are sufficient to clamp or hold two adjacent frames together when these members have been brought into effective contact with the aligned studs of the adjacent frame. However, any of several relatively uncomplicated locking means can be used to lock or join the side member 12 of one frame 10 to the side member 14 of an adjacent frame, and in some instances we can utilize a single joinder member to hold two frames together. When two of our frames are to be joined to form a love seat, or three of our frames are to be joined to form a couch or sofa, it is obvious that we are not to be limited to only using the joinder members 26.

Figure 10C:
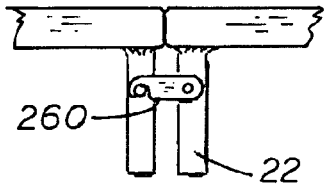
FIG. 10*c* is a fragmentary view illustrating an alternate arrangement for joining two of our novel frames together.

In FIG. 10C we have shown that we can join two of our frames together by utilizing a joinder member 260 similar to member 26 for securing together the legs of two of our frames that have been placed in an aligned, side-by-side relationship. Whether the side members of our novel frames are joined, or the legs joined, it is to be understood that when the event is over, the frames can be readily separated, and stacked back on a wheeled cart or dolly, for transfer to a truck or van located outside the event area.

Figure 11A:
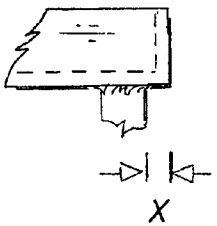
FIG. 11*a* is a fragmentary view showing how a typical leg of one of our novel frames is located in a recessed manner from the outer or external edge of the frame.
Figure 11:
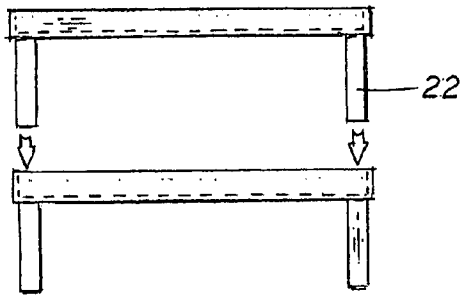
FIG. 11 reveals to a small scale, the fact that one of our novel frames can be stacked on a like frame in a secure manner.

With reference to FIG. 11, here we have diagrammatically indicated that one of our frames can be inserted or stacked onto an essentially identical frame residing therebelow, with the support legs of the two frames being in alignment. This is possible because we have installed the support legs on our frames in a somewhat recessed or inset relationship with regard to the exterior edges or corners of the frame. FIG. 11*a* illustrates that the leg (only the upper part showing) is disposed inboard of the outer edge of the frame member to en extent X, with the dimension X corresponding approximately to the thickness of the vertical leg or flange V of the structural member. A typical thickness of the vertical leg or flange V is one-quarter inch, but we are not to be limited to this.

Figure 12:
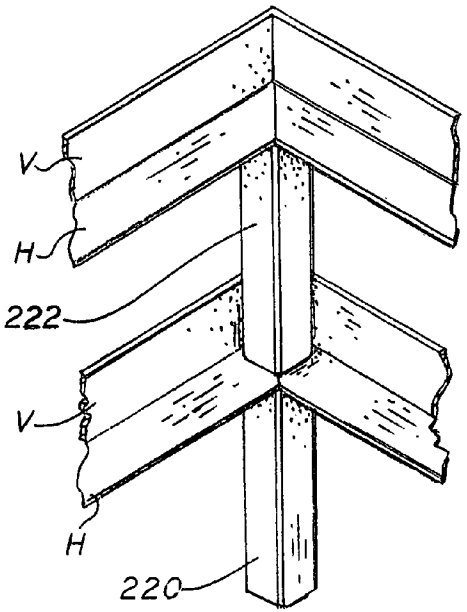
FIG. 12 illustrates to a large scale how the support leg of an upper frame can rest on the horizontal leg or lip of a lower frame, with the support leg of the upper frame, because of being recessed, avoiding contact with the upstanding, vertically disposed leg of the structural member of the lower frame.

In FIG. 12 we have shown in a fragmentary manner to a somewhat enlarged scale, the relationship of one supporting leg of one frame to the upstanding flange or upstanding leg V of a frame residing therebelow. More specifically, we in FIG. 12 have identified the supporting leg of the lower frame as 220, and the supporting leg of the upper frame as 222. It is obvious from this figure that because the supporting leg 222 is indented or inset (recessed) from the outer or external edges at the corner of the frame to which it is attached, that the lower portion of leg 222 can seat on the horizontal leg H of the lower frame without interference from the upstanding flange or leg V of the structural members located at the corner of the lower frame.

Because in a stacked relationship the lower portions of the support legs of each frame are bounded or enclosed by the upstanding legs V of the frame residing therebelow, a plurality of our frames can be stacked into a very secure relationship. In other words, because each support leg of an upper frame is bounded or enclosed by the intersecting upstanding legs V of a lower frame, any shifting of the frames when multiple frames are placed in a stack is highly unlikely.

Figure 13:
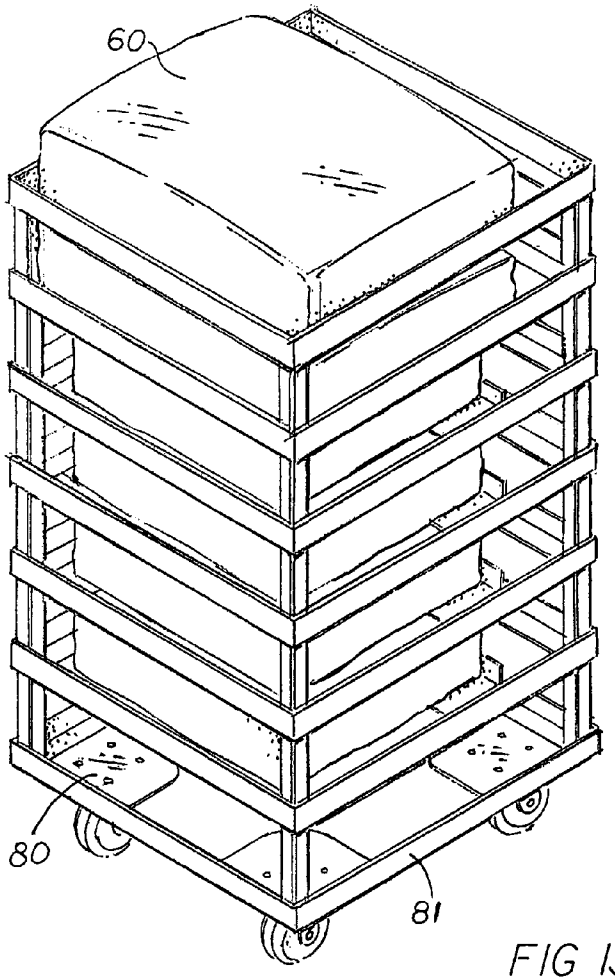
FIG. 13 is a view of several of our frames stacked on a wheeled cart, with the novel arrangement we use making it easily possible for one person working alone to move several of our frames from a delivery truck to a point of use, without the danger of the frames slipping off the wheeled cart.

In keeping with our goal of providing modular furniture that can be set up by a workman or laborer working alone, we illustrate in FIG. 13 a plurality of our stacked frames, with the lowermost frame of the stack resting on a wheeled cart 80. Because each supporting leg of each frame is set somewhat inwardly from the respective corner of the frame, as just explained, this readily permits the frames to be stacked in the secure configuration shown in FIG. 13. It is obvious that before the scheduled event the worker can stack the frames onto a wheeled cart 80 at the time he removes the frames from the delivery truck, and he can then roll the stacked assemblage into the ballroom, convention hall or the like. We prefer to use upstanding flanges 81 on the wheeled cart 80, to engage the lowermost portions of the supporting legs of the lowermost frame, to prevent displacement of the frames as the cart 80 moves to its destination. As previously mentioned, this same worker can separate the stacked frames and then quickly convert the frames into individual chairs, or in a joined relationship to form loveseats or sofas.

Separate sofa cushions are needed in each instance, whether chairs, loveseats or sofas are to be created, and it will be apparent from FIG. 13 that the sofa cushions 60 can be interspersed between the frames at the time the frames are being transported into the auditorium or assembly hall.

Figure 14:
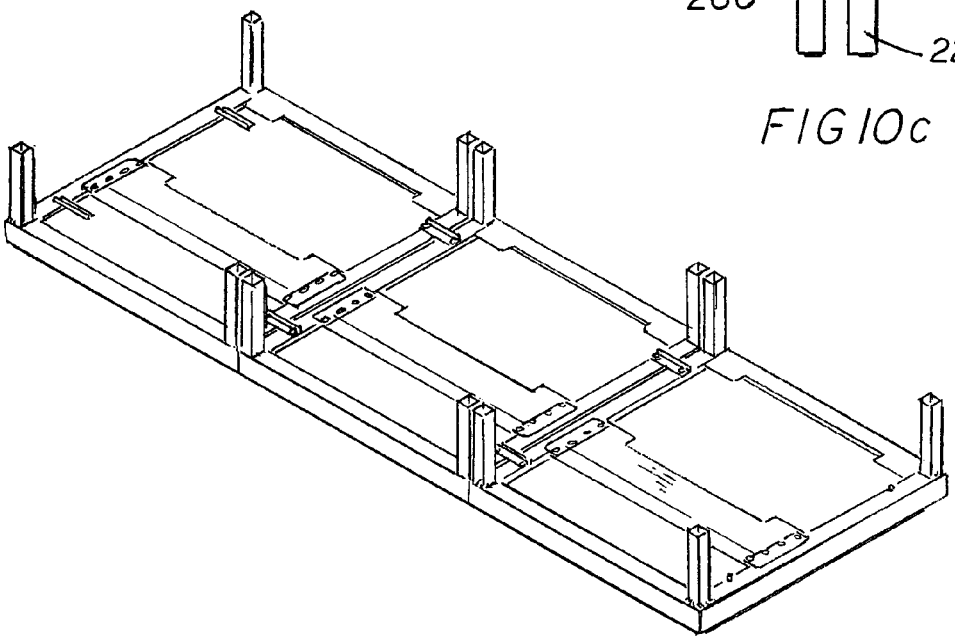
FIG. 14 reveals three of our novel frames having been secured together, with these frames at this time being in the inverted position to reveal additional details.

In FIG. 14 we have shown three of our novel frames joined together, with the frames in this instance inverted so as to clearly reveal the involved components. Apparent in FIG. 14, but to a small scale, are the locking bars and the joinder members.

Figure 15:
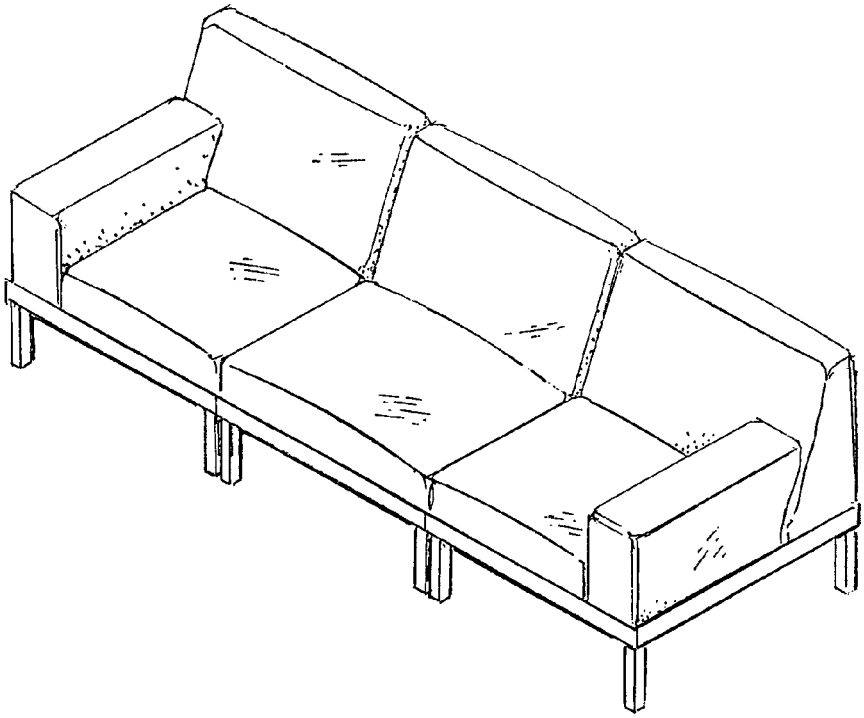
FIG. 15 is a view of a completed sofa or couch with all three backrests in secure position because of the placement of closely fitted sofa cushions.

With reference to FIG. 15, we have shown a couch or sofa in operable condition, involving three of our frames having been joined together, and upon which sofa cushions have been installed. In this instance, a first armrest is located on one end of the sofa and a second armrest has been installed on the other end. As previously mentioned, the sofa cushions that are used when an armrest is in place are somewhat smaller than the sofa cushion used in the mid-portion of the sofa of this figure.

We find it be advantageous to utilize Velcro or snaps on the underside of the backrest, the seat cushion and the arm rest, to make it possible for us to quickly change the outer covering to best meet the nature of the event.

We claim:

1. A frame for use in connection with modular furniture, said frame being of rectangular configuration and constructed of structural components, one of said components being a front component, and another a back component, with said back component having a straight edge thereon, and a pair of side components serving to interconnect said front and back components, and a locking bar member extending between said side components and being movable therealong while remaining essentially parallel to said back component, said locking bar member having a straight edge in alignment with and substantially parallel to said straight edge of said back component, such that when said locking bar member is brought into a close relation to said back component, said straight edges of said back component and said locking bar member can secure a backrest having cleats disposed on its lower portion, in a fixed position, a first area being defined between said front component, said side components, and said locking bar member, and a second area being defined between said back member, said locking bar member and said side components, said first area being caused to enlarge when said locking bar member is moved toward said back component, and blocking means configured to fit in said first area when said locking bar has moved into close relation with said back member, said blocking means preventing any displacement of a backrest whose cleats reside between said straight edges of said back component and said locking bar member.

2. The frame for use in connection with modular furniture as recited in claim 1 in which each of said side components has a straight lip extending therealong, with the ends of said locking bar member maintaining sliding contact with said straight lips of both of said side components as said locking bar member is caused to move along said side components.

3. The frame for use in connection with modular furniture as defined in claim 1 in which said blocking means is a seat cushion.

4. The frame for use in connection with modular furniture as defined in claim 1 in which said blocking means is an arm rest, adjacent which is a seat cushion.

5. The frame for use in connection with modular furniture as recited in claim 1 in which a pair of locking components of a first characteristic is mounted in a specific spaced relation on one of said side components, and a pair of locking components of a second, complementary characteristic is mounted in a substantially identical spaced relation on the other of said side components, whereby when a pair of like frames are placed in a side by side relationship, the pair of locking components of the first characteristic of said one frame can be interfitted with the locking components of the second characteristic of said other frame, thus to lock said frames together, and make possible the creation of a love seat in which the backrests of the two frames are in a substantially aligned relationship.

6. The frame for use in connection with modular furniture as recited in claim 1 in which a pair of locking components of a first characteristic is mounted in a specific spaced relation on one of said side components, and a pair of locking components of a second, complementary characteristic is mounted in a substantially identical spaced relation on the other of said side components, whereby when three like frames are placed in a side by side relationship, the pair of locking components of the first characteristic of a first of said frames can be interfitted with the locking components of the second characteristic of a second frame, and the pair of locking components of the first characteristic on the second of said frames can be interfitted with the locking components of the second characteristic on the third frame, thus to lock three frames together, and make possible the creation of a couch in which the backrests of the three frames are in a substantially aligned relationship.

7. The frame for use in connection with modular furniture as recited in claim 1 in which said frame has four corners, with a supporting leg utilized adjacent each of said corners, each supporting leg having an upper portion and a lower portion, said upper portion of each supporting leg secured to the underside of said horizontally disposed leg of the frame component, the upper portion of each supporting leg being spaced inwardly from adjacent exterior edges of said frame, with such inward spacing being of an extent approximately corresponding to the thickness of the vertically disposed leg of said structural components, with said inward spacing of each of said supporting legs making possible the secure stacking of one frame upon a lower substantially identical frame, such that the lower portion of each supporting leg of the one frame avoids undesirable contact with the vertically disposed leg of the structural components of the lower frame.

8. A frame for use in connection with modular furniture, said frame being of rectangular configuration and constructed of structural components, one of said components being a front component, and another being a back component, with said front and back components being interconnected by side components, said back component and said side components each having a generally L-shaped cross section, with a vertically disposed leg and a horizontally disposed leg; and a locking bar member extending between said side components and being movably mounted along the horizontally disposed leg of each of said side components, said locking bar member remaining essentially parallel to said back member as it is moved along said side components, said locking bar member having a straight edge in alignment with said horizontal leg of said back member, such that when said locking bar member is brought into a close relation to said back member, said locking bar member can hold a backrest equipped with cleats in a secure, fixed position, said frame having four corners, with a supporting leg utilized adjacent each of said corners, each supporting leg having an upper portion and a lower portion, said upper portion of each supporting leg secured to the underside of said horizontally disposed leg of the frame component, the upper portion of each supporting leg being spaced inwardly from the respective corner of said frame, with such inward spacing being of an extent approximately corresponding to the thickness of the vertically disposed leg of said structural components, with said inward spacing of each of said supporting legs making possible the secure stacking of one frame upon a lower substantially identical frame, such that the lower portion of each supporting leg avoids undesirable contact with the vertically disposed leg of the structural components of the lower frame.

9. The frame for use in connection with modular furniture as recited in claim 8 in which a first area is defined between said front component, said side components, and said locking bar member, and a second area is defined between said back component, said locking bar member and said side components, said first area being caused to enlarge when said locking bar member is moved toward said back component, and blocking means configured to fit in said first area when said locking bar member has moved into close relation with said back member, to prevent movement of said locking bar member that would release said backrest.

10. The frame for use in connection with modular furniture as defined in claim 9 in which said blocking means is a seat cushion.

11. The frame for use in connection with modular furniture as defined in claim 9 in which said blocking means is an arm rest, adjacent which is a seat cushion.

12. The frame for use in connection with modular furniture as recited in claim 8 in which a pair of locking components of a first characteristic is mounted in a specific spaced relation on one of said side components, and a pair of locking components of a second, complementary characteristic is mounted in a substantially identical spaced relation on the other of said side components, whereby when a pair of like frames are placed in a side by side relationship, the pair of locking components of the first characteristic of said one frame can be interfitted with the locking components of the second characteristic of said other frame, thus to lock said frames together, and make possible the creation of a love seat, in which the backrests of the two frames are in a substantially aligned relationship.

13. The frame for use in connection with modular furniture as recited in claim 8 in which a pair of locking components of a first characteristic is mounted in a specific spaced relation on one of said side components, and a pair of locking components of a second, complementary characteristic is mounted in a substantially identical spaced relation on the other of said side components, whereby when three like frames are placed in a side by side relationship, the pair of locking components of the first characteristic of a first of said frames can be interfitted with the locking components of the second characteristic of a second frame, and the pair of locking components of the first characteristic on the second of said frames can be interfitted with the locking components of the second characteristic on the third frame, thus to lock three frames together, and make possible the creation of a couch in which the backrests of the three frames are in a substantially aligned relationship.

14. A frame for use in connection with modular furniture, being designed to receive, when transported to a remote location, seat components and backrest components, with said components being held in place without the use of tools, said frame being of rectangular configuration and constructed of structural components, one of said structural components being a front component, with a back structural component provided at the opposite end of said frame, and with said front and back structural components being interconnected by side structural components, said front and back structural components and said side structural components each having an inwardly directed, horizontally projecting lip element; and a locking bar member extending between said side structural components and being slidably mounted on said horizontally projecting lip elements, said locking bar member being movable along said side structural components while remaining essentially parallel to said back structural component, said locking bar member having an edge in alignment with and substantially parallel to said horizontal lip element of said back structural component, whereby when said locking bar member is brought into a relatively close relation to said back structural component, said locking bar member can hold a backrest equipped with cleats in a secure, fixed position, a first area being defined between said front component, said side components, and said locking bar member, and a second area being defined between said back structural component, said locking bar member and said side components, said first area being caused to enlarge when said locking bar member is moved toward said back structural component, and blocking means configured to fit in said first area when said locking bar has moved into close relation with said back structural component, to prevent movement of said locking bar member that would release said backrest.

15. The frame for use in connection with modular furniture as defined in claim 14 in which said blocking means is a seat cushion.

16. The frame for use in connection with modular furniture as defined in claim 14 in which said blocking means is an arm rest, adjacent which is a seat cushion.

17. The frame for use in connection with modular furniture as defined in claim 16 in which the underside of said arm rest is provided with cleats that can contact and engage the horizontal lip element of one of said side components.

18. The frame for use in connection with modular furniture as recited in claim 14 in which a pair of locking components of a first characteristic is mounted in a specific spaced relation on one of said side components, and a pair of locking components of a second, complementary characteristic are mounted in a substantially identical spaced relation on the other of said side components, whereby when a pair of like frames are placed in a side by side relationship, the pair of locking components of the first characteristic of said one frame can be interfitted with the locking components of the second characteristic of said other frame, thus to lock said frames together, and make possible the creation of a love seat, in which the backrests of the two frames are in a substantially aligned relationship.

19. The frame for use in connection with modular furniture as recited in claim 14 in which a pair of locking components of a first characteristic is mounted in a specific spaced relation on one of said side components, and a pair of locking components of a second, complementary characteristic is mounted in a substantially identical spaced relation on the other of said side components, whereby when three like frames are placed in a side by side relationship, the pair of locking components of the first characteristic of a first of said frames can be interfitted with the locking components of the second characteristic of a second frame, and the pair of locking components of the first characteristic of the second of said frames can be interfitted with the locking components of the second characteristic of the third frame, thus to lock three frames together, and make possible the creation of a couch in which the backrests of the three frames are in a substantially aligned relationship.

20. The frame for use in connection with modular furniture as recited in claim 14 in which said frame has four corners, with a supporting leg utilized adjacent each of said corners, each supporting leg having an upper portion and a lower portion, said upper portion of each supporting leg secured to the underside of said horizontally disposed leg of the frame component, the upper portion of each supporting leg being spaced inwardly from the respective exterior corner edge of said frame, with such inward spacing being of an extent approximately corresponding to the thickness of the vertically disposed leg of said structural components, with said inward spacing of each of said supporting legs making possible the secure stacking of one frame upon a lower substantially identical frame, such that the lower portion of each supporting leg of the one frame avoids undesirable contact with the vertically disposed leg of the structural components of the lower frame.

21. The frame for use in connection with modular furniture as recited in claim 20 in combination with a wheeled device for supporting a stack of frames, said wheeled device having an upper surface upon which a stack of frames can be placed, and flanged members disposed around the sides of said upper surface for engaging the lower portions of the supporting legs of the lowermost frame of the stack, thus to prevent an undesirable displacement of the stack of frames.

* * * * *